US006520613B1

(12) United States Patent
Tamura

(10) Patent No.: US 6,520,613 B1
(45) Date of Patent: Feb. 18, 2003

(54) RECORDING HEAD AND RECORDING APPARATUS

(75) Inventor: Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/869,924

(22) Filed: Jun. 5, 1997

(30) Foreign Application Priority Data

Jun. 7, 1996 (JP) ..... 8-145975
Jul. 31, 1996 (JP) ..... 8-200866

(51) Int. Cl.[7] ..... B41J 29/38; B41J 29/393
(52) U.S. Cl. ..... 347/12; 347/19
(58) Field of Search ..... 347/12, 19, 13, 347/42, 180, 181, 182, 9, 10, 14, 11, 23

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,649,401 | A | 3/1987 | Kojima et al. |
| 4,723,129 | A | 2/1988 | Endo et al. |
| 4,740,796 | A | 4/1988 | Endo et al. |
| 5,300,968 | A | 4/1994 | Hawkins |
| 5,477,243 | A | 12/1995 | Tamura |
| 5,485,178 | A | 1/1996 | Tateyama et al. |
| 6,126,261 | A | 10/2000 | Yamanaka |

FOREIGN PATENT DOCUMENTS

| | | |
|---|---|---|
| EP | 0 574 911 | 12/1993 |
| EP | 0 678 386 | 10/1995 |
| EP | 0 688 671 | 12/1995 |
| EP | 0 709 197 | 5/1996 |
| JP | 54056847 | 5/1979 |
| JP | 59123670 | 7/1984 |
| JP | 60071260 | 4/1985 |
| JP | 63-264371 | 11/1988 |
| JP | 02-217253 | 8/1990 |
| JP | 3153367 | 7/1991 |
| JP | 59138461 | 8/1994 |

*Primary Examiner*—Craig Hallacher
*Assistant Examiner*—Charles W. Stewart, Jr.
(74) *Attorney, Agent, or Firm*—Fitzpatrick, Cella, Harper & Scinto

(57) ABSTRACT

Disclose is a reliable recording head free from any operation error. M×N recording elements are divided into N blocks each having M recording elements, and are driven for every M recording elements N times. M×N driving circuits energize and drive the M×N recording elements. A selection circuit outputs N block selection signals for selecting the N blocks to be divisionally driven. An input circuit inputs recording data corresponding to the M recording elements. An output circuit outputs a driving signal to the driving circuits in accordance with the recording data input from the input circuit and the block selection signals. The selection circuit outputs the N block selection signals on the basis of L (L<N) control signals.

31 Claims, 10 Drawing Sheets

FIG. 6A B1
FIG. 6B B2
FIG. 6C B3
FIG. 6D B4
FIG. 6E ENB
FIG. 6F CK
FIG. 6G LATCH
FIG. 6H DATA
HEATING ELEMENT DRIVING TIME (SEVERAL μ SECONDS)
HEATING ELEMENT DRIVING TIME

RECORDING HEAD AND RECORDING APPARATUS

BACKGROUND OF THE INVENTION

1. Field of the Invention

The present invention relates to a recording head and a recording apparatus using it and, more particularly, to a recording head of an ink jet type in which an ink is ejected using thermal energy, and a recording apparatus using it.

2. Related Background Art

In a recording head of the ink jet type in which recording is performed using thermal energy, a heating element is arranged on a flow path communicating with an ejection outlet for ejecting an ink droplet. This heating element is energized for about several $\mu$ sec to generate bubbles in the ink and eject ink droplets, thereby performing recording. In this recording head, large numbers of ejection outlets and heating elements can be easily arranged at a high density to enable recording of a high-resolution image.

If all the heating elements of this recording head are simultaneously driven, a current flowing at once increases. Normally, several ten or hundred heating elements are divided into about 4 to 8 blocks, and driving timings for the respective blocks are slightly shifted from each other to suppress the current flowing at to be small.

If lines for supplying power to the respective heating elements are externally arranged to the recording head in order to drive the many heating elements, the number of wiring lines increases to complicate the electrical connection between the recording head;and a recording apparatus main assembly mounting it. For this reason, the recording head normally incorporates a driving circuit for the heating elements to prevent an increase in the number of wiring lines between the recording head and the recording apparatus. This driving circuit is arranged independently of the board of the heating elements, and they are connected by wire bonding or the like. Recently, an Si (silicon) wafer including a driving circuit has widely been used as the board of the heating elements.

This driving circuit can be variously constituted, and typical arrangements thereof will be described below.

(1) As the most popular arrangement, the driving circuit comprises a shift register having bits equal in number to heating elements, a latch circuit, gates, and transistors. Recording data is serially transferred from the recording apparatus to the shift register, and latched. This latched signal drives a transistor through a gate corresponding to a driving signal supplied for each block.

(2) In this arrangement, a diode matrix is employed. That is, heating elements are wired in an N×M matrix, and diodes are arranged in series with the respective heating elements in order to avoid crosstalk of currents between the respective heating elements. Therefore, the number of wiring lines for connecting the recording head to the outside is only N+M.

(3) This arrangement uses a transistor matrix and a circuit in which transistors are arranged in correspondence with respective heating elements, each collector is connected to one end of a corresponding heating element, and the emitters are commonly connected. The power supply lines for the heating elements and the base signal lines for the transistors are wired in a matrix to drive them. Therefore, the number of wiring lines for connecting the recording head to the outside is larger than that of the arrangement using the diode matrix by only the common wiring line for the emitters. The transistor may be a bipolar transistor or an FET.

The above conventional driving circuits, however, have the following problems.

More specifically, although the number of wiring lines to be connected is advantageously small in the arrangement (1) having the shift register and the latch circuit, the circuit is bulky and its cost is high. Particularly, when many heating elements are used, the manufacturing yield of the driving circuit is low, greatly increasing the cost. In driving the heating elements, a large current instantaneously flows to generate strong electrical noise. In the circuit with this arrangement, since many flip-flops are driven with high-speed clocks, data in the shift register may be shifted by the noise or may change. In addition, since the heating elements are divided into a plurality of blocks, and driven at slightly different operation timings, strong noise is repeatedly generated during one data transfer, further increasing the probability of an operation error.

In the circuit using the diode matrix or the transistor matrix, no flip-flop is basically used. Even if strong noise is mixed, the circuit normally operates except the noise mixture moment. The instantaneous noise does not influence the subsequent operation, so operation errors rarely occur. Normally, while the driving time of the heating elements in one recording operation is several $\mu$sec, the noise generation time is about 10 nsec, and the influence of noise can be ignored. However, in either of the two circuit arrangements, the power line must be switched at a high speed by a circuit on the recording apparatus side for driving the driving circuit in the recording head. For this reason, the driving circuit on the recording apparatus side becomes bulky and requires high cost. Further, the power loss is large due to the presence of two transistors between the power supply and ground of the recording head to perform switching on the positive and negative sides of the heating element.

In the matrix drive circuit using the diode matrix or the transistor matrix, N+M or more signal lines are required. Accordingly, the number of wiring lines for electrically connecting the recording head and the recording apparatus disadvantageously increases in the recording head, which has a large number of nozzles, i.e., drives many heating elements. As a result, the cost increases, and the reliability is degraded.

SUMMARY OF THE INVENTION

It is an object of the present invention to provide a compact, low-cost recording head with high reliability free from any operation error, and a recording apparatus using it.

To achieve the above object, according to the present invention, there is provided a recording head comprising M×N recording elements which are divided into N blocks each having M recording elements and are driven for every M recording elements N times, M×N driving circuits for energizing and driving the M×N recording elements, a selection circuit for outputting N block selection signals for selecting the N blocks to be divisionally driven, an input circuit for inputting recording data corresponding to the M recording elements, and an output circuit for outputting a driving signal to the driving circuits in accordance with the recording data input from the input circuit and the block selection signals, wherein the selection circuit outputs the N block selection signals on the basis of L (L<N) control signals.

According to the present invention, there is provided a recording apparatus comprising a recording head, the recording head comprising M×N recording elements which are divided into N blocks each having M recording elements and are driven for every M recording elements N times, M×N driving circuits for energizing and driving the M×N recording elements, a selection circuit for outputting N block selection signals for selecting the N blocks to be divisionally driven, an input circuit for inputting recording data corresponding to the M recording elements, an output circuit for outputting a driving signal to the driving circuits in accordance with the recording data input from the input :circuit and the block selection signals, wherein the selection circuit outputs the N block selection signals on the basis of L (L<N) control signals, means for supplying the recording data to the recording head, and means for supplying the L control signals to the recording head.

DESCRIPTION OF THE PREFERRED EMBODIMENTS

Preferred;embodiments of the present invention will be described in detail below with reference to the accompanying drawings.

Schematic Description of Apparatus Main Assembly

Figure 1:
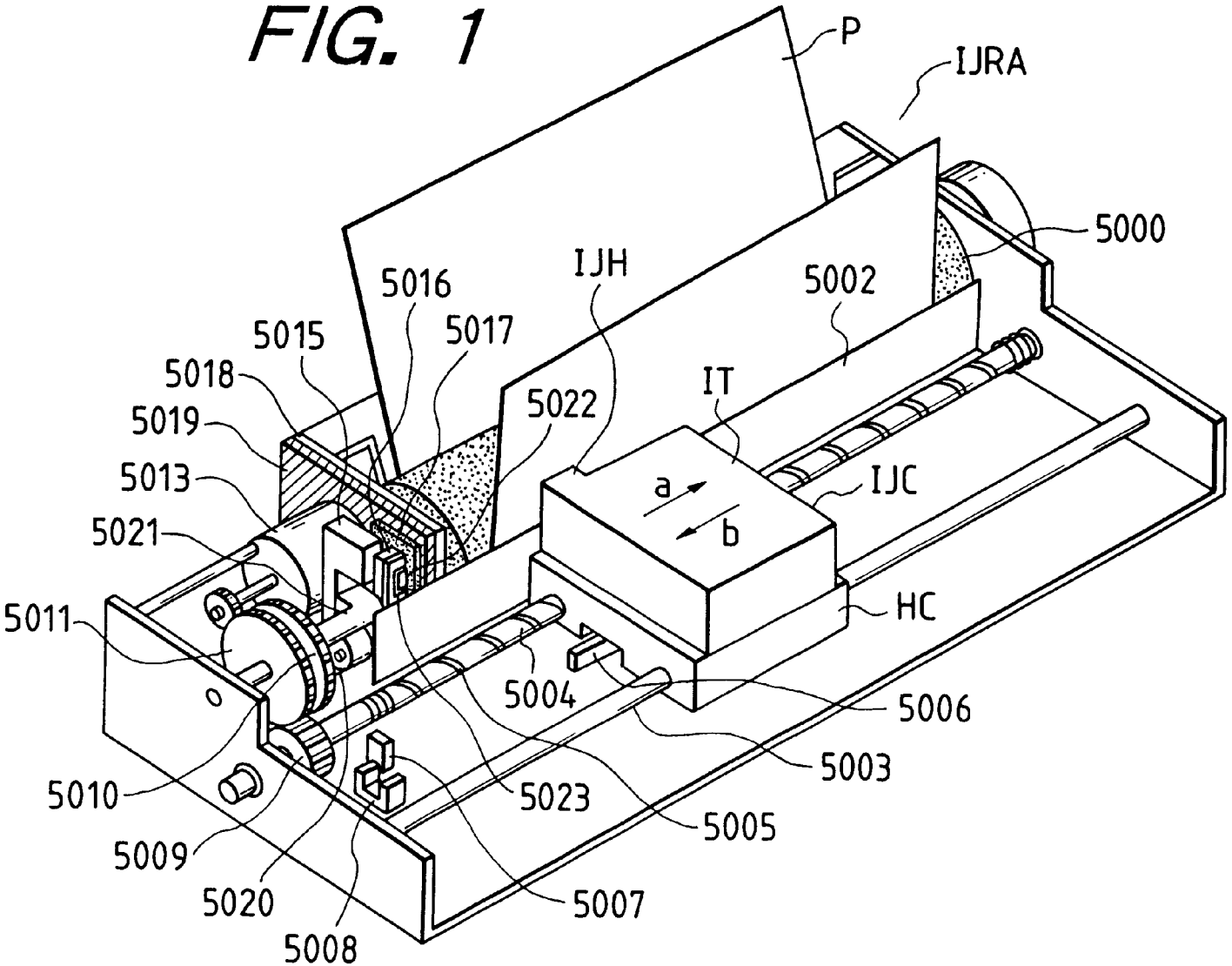
FIG. 1 is a perspective view showing the schematic outer appearance of an ink jet printer IJRA according to a typical embodiment of the present invention.

FIG. 1 is a perspective view showing the schematic outer appearance of an ink jet printer (to be referred to as a printer hereinafter) IJRA according to a typical embodiment of the present invention. In FIG. 1, a pin (not shown) is arranged on a carriage HC engaged with a spiral groove 5005 of a lead screw 5004 which is interlocked with forward/reverse rotation of a driving motor 5013 to rotate through driving force transmission gears 5009 to 5011. The carriage HC is supported by a guide rail 5003 to reciprocally move in directions indicated by arrows a and b. An integral ink jet cartridge IJC incorporating a recording head IJH and an ink tank IT is mounted oh the carriage HC. A paper press plate 5002 presses a recording paper sheet P against a platen 5000 over the movement direction of the carriage HC. Photocouplers 5007 and 5008 serve as home position detectors for, e.g., checking the presence of a carriage lever 5006 in this range and switching the rotation direction of the driving motor 5013. A member 5016 supports a capping member 5022 which caps the front surface of the recording head IJH. A sucking member 5015 sucks the interior of the cap to perform suction/recovery of the recording head through an intra-cap opening 5023. A member 5019 allows a cleaning blade 5017 to move forward and backward, and they are supported by a main assembly support plate 5018. The blade is not limited to this form, and a known cleaning blade is applicable to this embodiment, as a matter of course. A lever 5021 for starting suction of suction/recovery moves together with a cam 5020 engaged with the carriage, while a driving force from the driving motor is controlled by a known transmission mechanism such as a clutch switch.

Desired capping, cleaning, and suction/recovery can be performed at corresponding positions by the function of the lead screw 5005 when the carriage comes to the home position side. If they are desirably performed at known timings, these operations are applicable to this embodiment.

Description of Control Arrangement

A control arrangement for executing recording control of the above-mentioned apparatus will be described below.

Figure 2:
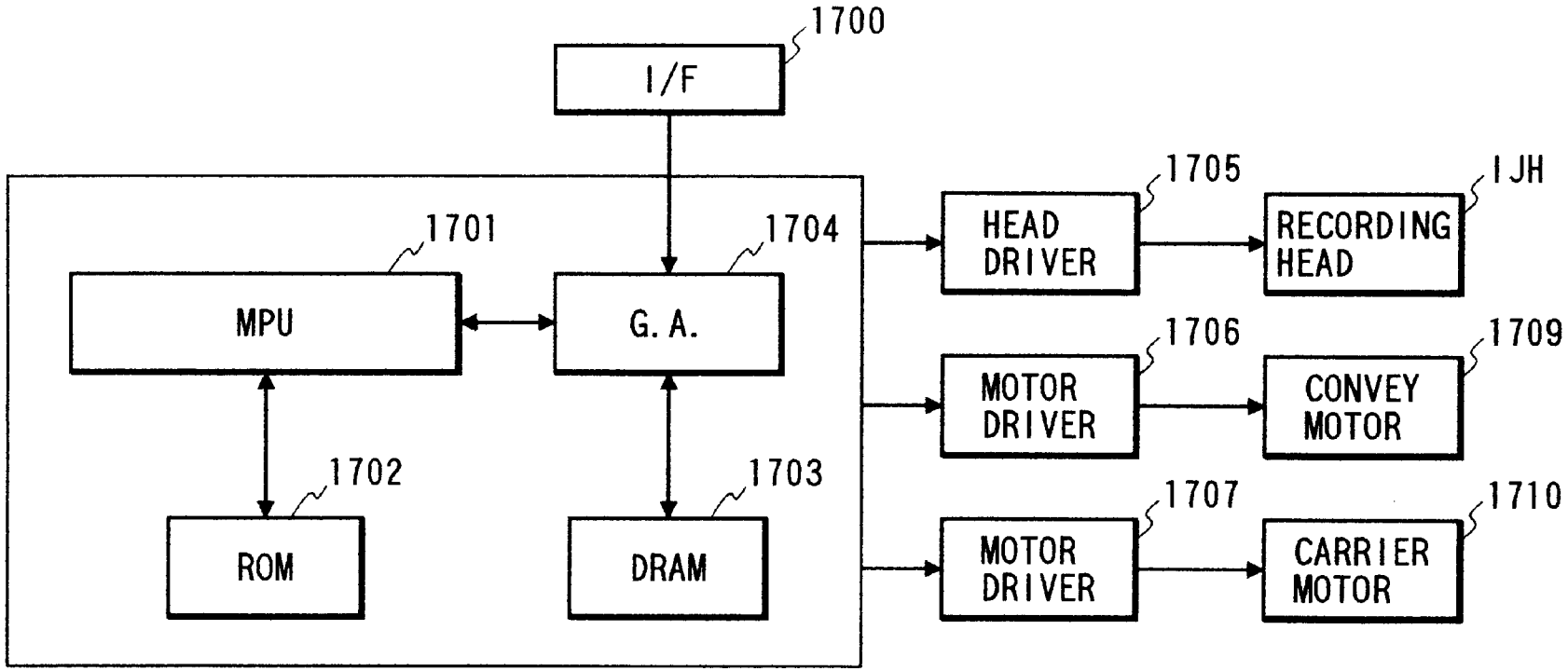
FIG. 2 is a block diagram showing the arrangement of the control circuit of the ink jet printer IJRA.

FIG. 2 is a block diagram showing the arrangement of the control circuit of the printer IJRA. In FIG. 2 showing the control circuit, an interface 1700 inputs a recording signal, a program ROM 1702 stores a control program executed by an MPU 1701, and a dynamic RAM 1703 stores various data (the recording signal, recording data supplied to the head, and the like). A gate array 1704 controls the supply of the recording data to the recording head IJH, and also controls data transfer between the interface 1700, the MPU 1701, and the RAM 1703. A carrier motor 1710 conveys the recording head 1708, and a convey motor 1709 conveys the recording paper sheet. A head driver 1705 drives the head, and motor drivers 1706 and 1707 respectively drive the convey motor 1709 and the carrier motor 1710.

The operation of the above control arrangement will be explained. When the recording signal is input to the interface 1700, it is converted to print recording data between the gate array 1704 and the MPU 1701. The motor drivers 1706 and 1707 are driven, and at the same time the recording head is driven in accordance with: the recording data sent to the head driver 1705 to perform recording.

Three embodiments of the recording head IJH used in the printer IJRA having the above arrangement will be described below. Throughout the embodiments to be described below, the recording head IJH has 128 recording elements, the recording elements are divided into 16 blocks (division number N: 16) each having 8 recording elements, and a total of 8 recording elements, i.e., one recording element of each block are simultaneously driven (simultaneous driving recording element count M: 8).

In the three embodiments, the same reference numerals (symbols) denote the same constituent elements.

First Embodiment of Recording Head IJH

Figure 3:
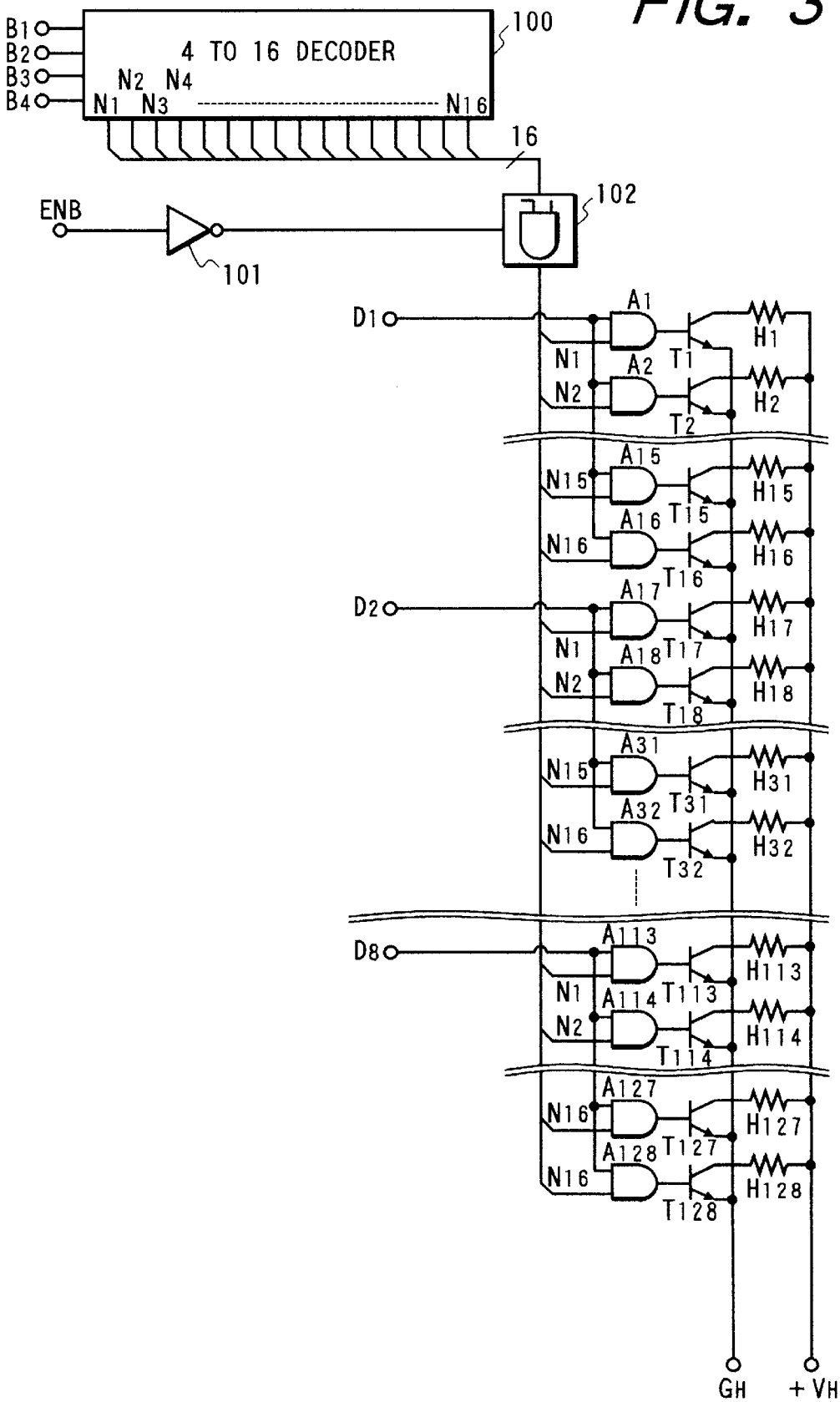
FIG. 3 is a block diagram showing the arrangement of the driving circuit of a recording head IJH according to the first embodiment.
Figures 4A, 4B, 4C, 4D, 4E, 4F, 4G, 4H:
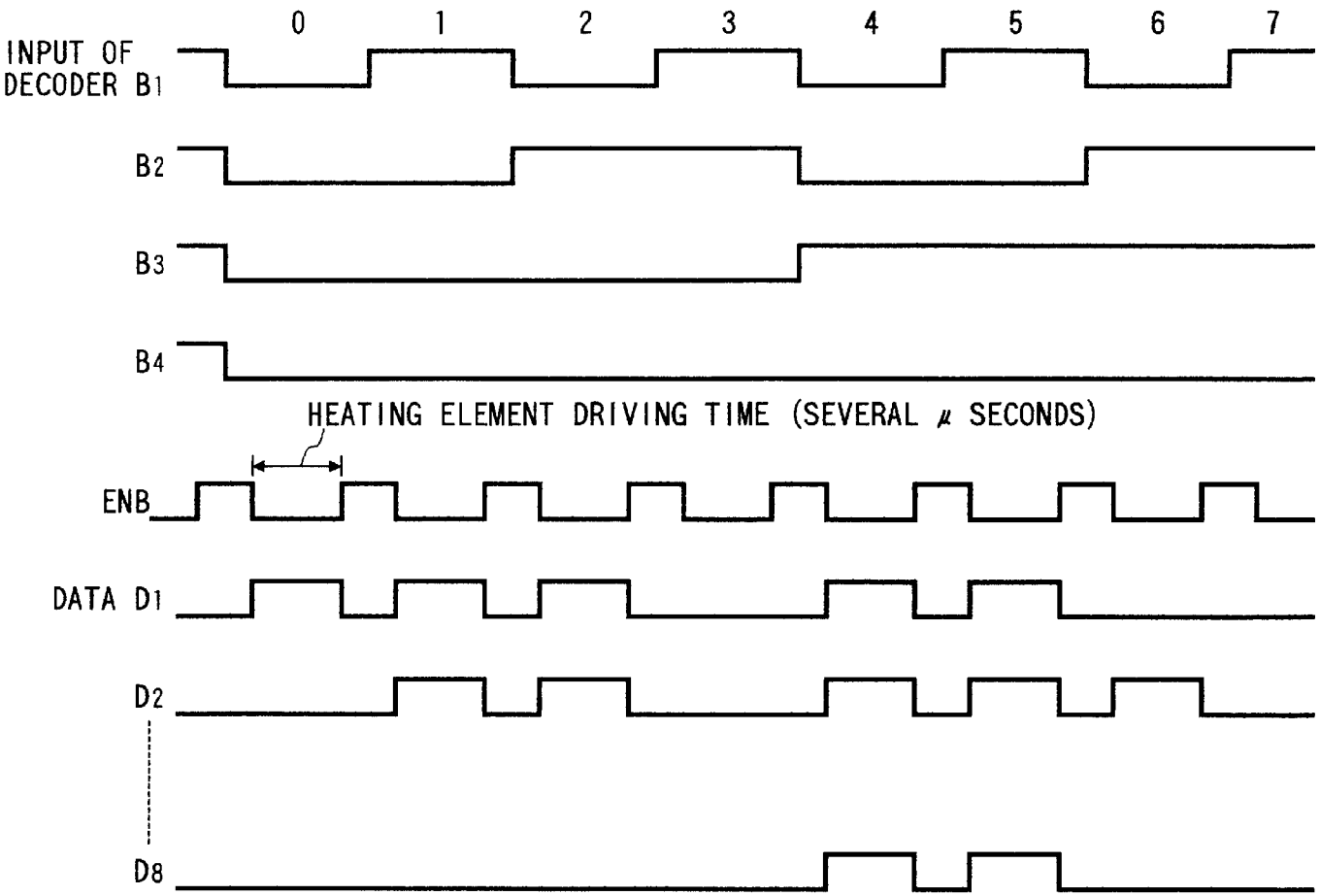
FIGS. 4A, 4B, 4C, 4D, 4E, 4F, 4G, and 4H are timing charts showing driving timings for the recording head IJH having the arrangement shown in FIG. 3.

FIG. 3 is a block diagram showing the arrangement of the driving circuit of a recording head IJH according to the first embodiment. In FIG. 3, a 4 to 16 decoder 100 decodes block control signals B1, B2, B3, and B4 supplied from the printer IJRA to generate block selection signals N1, N2, . . . , N16. An inverter 101 inverts an enable signal ENB supplied from the printer IJRA. Sixteen AND circuits 102 calculate the ANDs between the inverted enable signal ENB and the respective block selection signals N1, N2, . . . , N16. Heating elements H1 to H128 are energized by power transistors T1 to T128, and AND circuits A1 to A128 correspond to the power transistors T1 to T128.

The AND circuits A1 to A128 calculate the ANDs between recording signals D1 to D8 input from the printer IJRA and the block selection signals N1, N2, . . . , N16.

As is apparent from this arrangement, the division number (N) of recording elements is 16, and the 16 block selection signals N1, N2, . . . , N16 are generated by the decoder on the basis of the block control signals B1, B2, B3, and B4 input through 4 signal lines (L). To certainly prevent the heating elements H1 to H128 from being driven by an operation error, a signal line for supplying the enable signal ENB is arranged.

FIGS. 4A to 4H are timing charts showing driving timings for the recording head IJH having the arrangement shown in FIG. 3. According to the timing charts, signals representing 0 (000 in binary expression) to 15 (1111 in binary expression) are sequentially sent in combination of the block control signals B1 to B4 (FIGS. 4A to 4D) sent from the printer IJRA. In response to these signals, the block selection signals N1 to N16 as the outputs from the 4 to 16 decoder 100 rise ("high") one by one. These block selection signals are supplied to the AND circuits A1 to A128 and the power transistors T1 to T128, and to the heating elements H1 to H1 not directly but through the AND circuits 102.

The AND circuits 102 receive the inverted signal of the enable signal ENB (FIG. 4E) sent from the printer IJRA. Only when the enable signal ENB is "low", the block selection signals N1 to N16 are supplied to the heating elements to drive them.

The heating times (several $\mu$sec) and timings of the heating elements can be determined by the enable signal ENB or the recording signals D1 to D8 (FIGS. 4F to 4H), or may be controlled using double pulses as the enable signal. In this circuit, the heat pulse width can be controlled for each heating element by controlling the data pulse width, thereby finely controlling ejection of the ink jet head.

In the arrangement shown in FIG. 3, 15 signal lines including a supply line for the power supply voltage ($V_H$) and a signal line for the ground voltage ($G_H$) (8 signal lines for the recording signals D1 to D8, 4 signal lines for the block control signals B1 to B4, and signal lines respectively for the enable signal ENB, the power supply voltage ($V_H$), and the ground voltage ($G_H$)) are arranged between the recording head IJH and the printer IJRA.

According to this embodiment, the heating elements are driven not directly by the block selection signals obtained by decoding the block control signals supplied from the printer IJRA but by the enable signal and the block selection signals. Therefore, the heating elements are prevented from being driven by, e.g., an operation error of the decoder. Since the N block selection signals are generated from the L (L<N) block control signals, the number of signal lines extending from the printer main assembly can be further decreased.

Second Embodiment of Recording Head IJH

Figure 5:
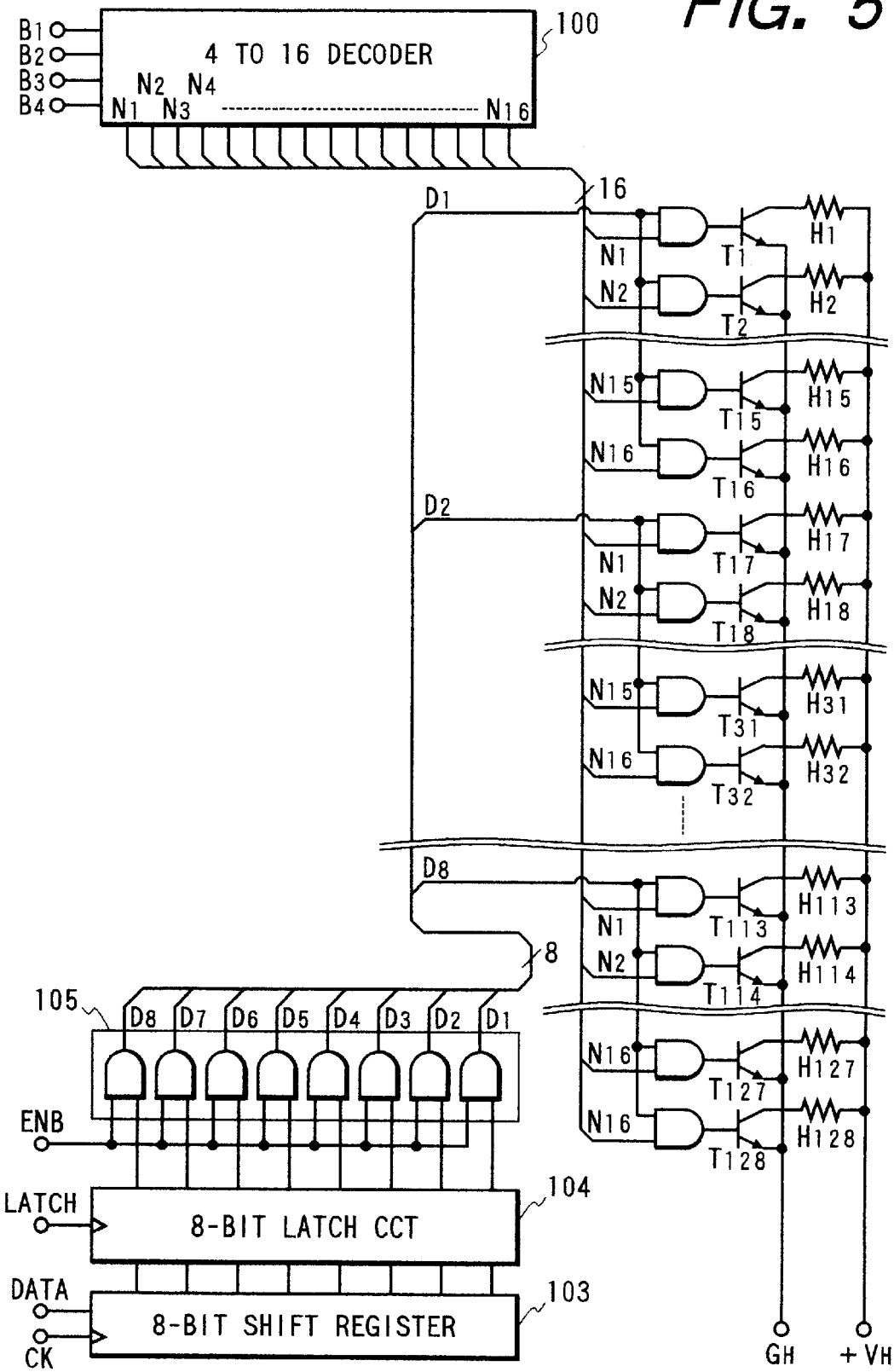
FIG. 5 is a block diagram showing the arrangement of the driving circuit of a recording head IJH according to the second embodiment.
Figure 6:
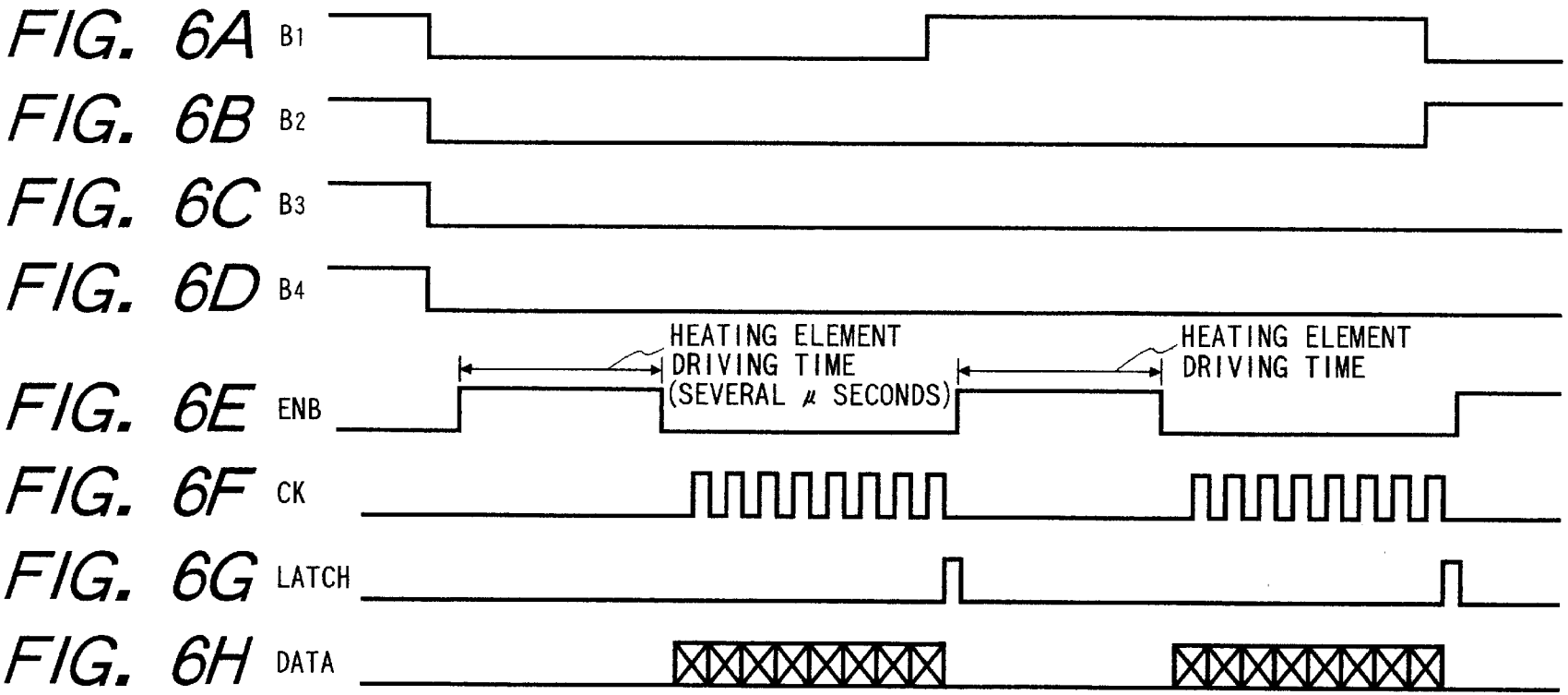
FIGS. 6A, 6B, 6C, 6E, 6F, 6G and 6H are timing charts showing driving timings for the recording head IJH having the arrangement shown in FIG. 5.

FIG. 5 is a block diagram showing the arrangement of the driving circuit of a recording head IJH according to the second embodiment. In this circuit, the recording signals D1 to D8 supplied to the recording head IJH of the first embodiment are supplied through a shift register and a latch circuit. In FIG. 5, an 8-bit shift register 103 serially receives recording data DATA in response to a clock signal CK supplied from the printer IJRA. An 8-bit latch circuit 104 latches the 8-bit recording data DATA stored in the 8-bit shift register 103 in response to a latch signal LATCH supplied from the printer IJRA. An AND circuit 105 calculates the AND between the enable signal ENB and each bit of the 8-bit data latched in the 8-bit latch circuit 104.

The outputs from the AND circuit 105 are supplied as the recording signals D1 to D8 to the heating elements. The driving timings and pulse widths of the heating elements are determined by these outputs and the block selection signals N1 to N16 as the outputs from a 4 to 16 decoder 100. Compared to the first embodiment, the enable signal ENB becomes active with positive logic in the second embodiment. That is, when the enable signal ENB is "high", the heating elements are driven.

In the arrangement shown in FIG. 5, 10 signal lines including a supply line for the power supply voltage ($V_H$) and a signal line for the ground voltage ($G_H$) (4 signal lines for the block control signals B1 to B4, and signal lines respectively for the recording data DATA, the clock CK, the enable signal ENB, the latch signal LATCH, the power supply voltage ($V_H$), and the ground voltage ($G_H$)) are arranged between the recording head IJH and the printer IJRA. In this manner, the number of signal lines in this arrangement becomes much smaller than that in the arrangement of the first embodiment.

FIGS. 6A to 6H are timing charts showing driving timings for the;recording head IJH shown in FIG. 5. According to the timing charts, the timing for serially transferring the recording data to the 8-bit shift register 103 is shifted from the timing for driving the heating elements. Generation of noise concentrates around the edge of the heat pulse (enable signal ENB). However, under the control as shown in FIGS. 6A to 6H, the timing of the enable signal ENB may come near or overlap the data transfer timing once or twice in one data transfer at most. Therefore, the probability of an operation error can be substantially ignored.

Under the control of the MPU 1701 of the printer IJRA through the head driver 1705, noise is prevented from being generated by the heating element which is erroneously driven during transfer of the recording data. The probability of an operation error can be substantially ignored.

According to this embodiment, occurrence of an operation error can be prevented by controlling recording so as not to drive the heating element, which is the cause of noise, during transfer of the recording data.

By arranging the shift register and the latch circuit on the driving circuit, the number of signal lines between the printer IJRA and the recording head is further decreased. A cable connecting the recording head and the printer is shortened, realizing the downsizing and cost reduction of the apparatus.

If the recording data is transferred after driving the heating elements, as shown in FIGS. 6A to 6H, the 8-bit latch circuit 104 shown in FIG. 5 can be omitted to further downsize the circuit.

Note that AND gates for calculating the ANDs between the block selection signals N1 to N16 as the outputs from the 4 to 16 decoder 100 and the enable signal ENB may be arranged in the above arrangement, like the first embodiment. With this arrangement, the heating elements can be more certainly prevented from being driven by an operation error.

For a recording head having a large number of heating elements, the capacity of the shift register may be increased. However, to drive the many heating elements without increasing the clock frequency, a plurality of shift registers and latch circuits may be arranged, while the decoder is commonly used for the heating elements driven by the individual shift registers.

Third Embodiment of Recording Head IJH

Figure 7:
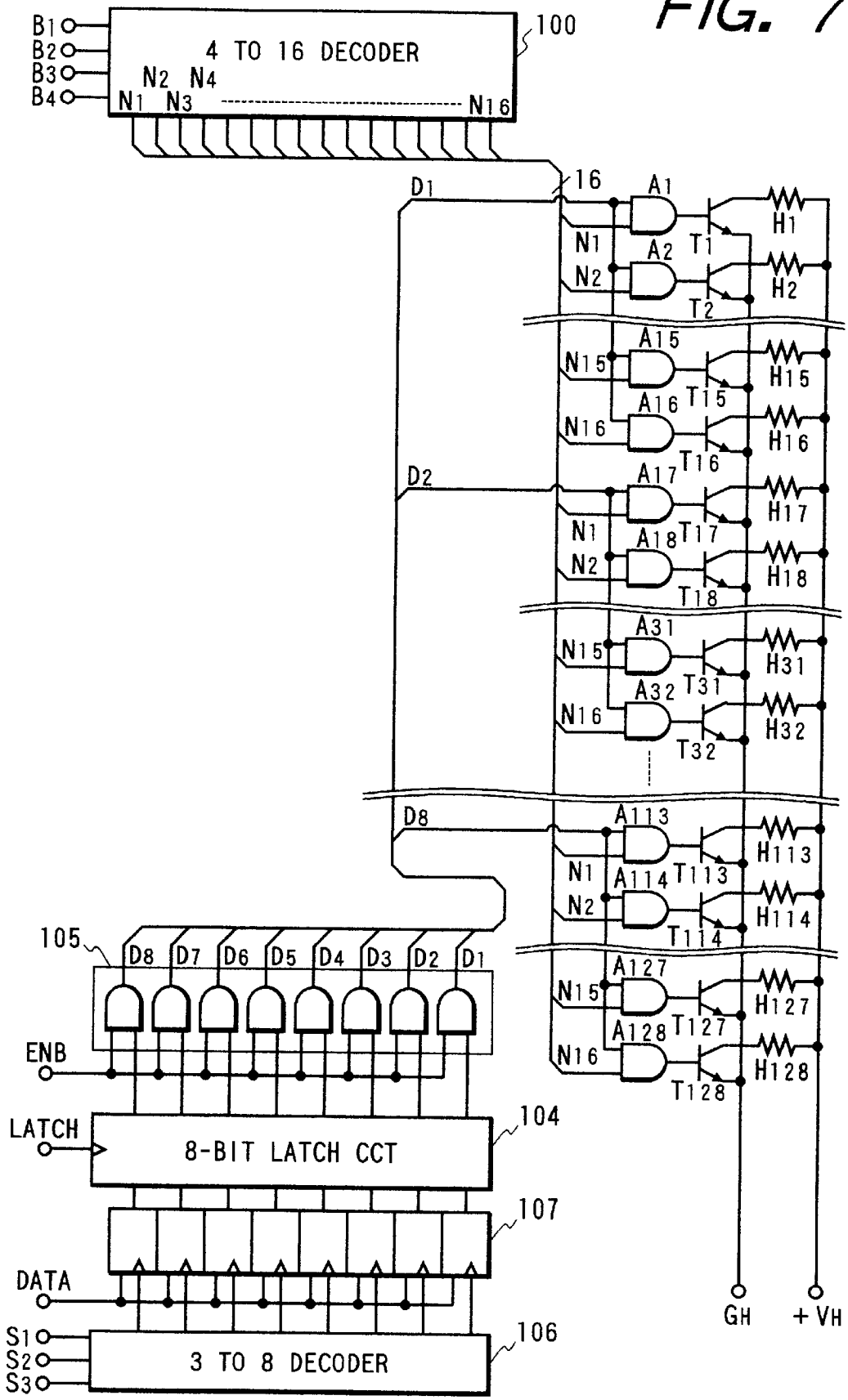
FIG. 7 is a block diagram showing the arrangement of the driving circuit of a recording head IJH according to the third embodiment.

FIG. 7 is a block diagram showing the arrangement of the driving circuit of a recording head IJH according to the third embodiment. In this circuit, 8 flip-flop circuits and a 3 to 8 decoder for decoding data selection signals S1, S2, and S3 corresponding to 3 bits replace the 8-bit shift register 103 incorporated in the recording head IJH of the second embodiment. In FIG. 7, a 3 to 8 decoder 106 and flip-flop circuits 107 are arranged.

In the driving circuit having this arrangement, the recording data DATA is serially transferred, as in the second embodiment. One bit is held by one of the flip-flop circuits 107 selected in accordance with the output sent from the 3 to 8 decoder 106 in synchronism with the transfer. After all data corresponding to 8 bits is held by the flip-flop circuits 107, it is stored in a latch circuit 104. The remaining arrangement is similar to the second embodiment.

In this embodiment, the number of signal lines between the recording head IJH and the printer IJRA is 12 (4 signal lines for the block control signals B1 to B4, 3 signal lines for the data selection signals S1 to S3, and signal lines respectively for the recording data DATA, the enable signal ENB, the latch signal LATCH, the power supply voltage ($V_H$), and the ground voltage ($G_H$)). The number of signal lines is slightly larger than that in the second embodiment using the shift register. However, in the use of the shift register, the whole array of transfer data shifts if only 1-pulse noise is mixed in the clock signal CK, and dots are recorded at erroneous positions. To the contrary, in this embodiment, even if noise corresponding to 1-bit data is similarly mixed during data transfer, the occurrence range of an operation error is limited to only this one bit.

In this manner, according to this embodiment, the occurrence range of an operation error upon noise mixing can be further localized. As in this embodiment, the circuit using the flip-flop is much smaller in size,than the shift register. Therefore, the probability of an operation error due to noise can be further reduced in terms of the circuit arrangement.

In this embodiment, similar to the second embodiment, the recording head having a large number of heating elements may comprise a plurality of latch circuits and a 3 to 8 decoder in order to drive the many heating elements without increasing the clock frequency.

When an Si board or the like is used for the heating elements, the driving circuit of the above-described recording head can be built in the board. Alternatively, the driving circuit may be connected as a board having the heating elements. This driving circuit is applicable to a so-called side shooter type recording head which ejects the ink in the direction vertical to the board of the heating elements, or a so-called edge shooter type recording head which ejects the ink from the end face of the board in the direction parallel to the board.

The main part of the driving circuit of the recording head according to the above-described three embodiments is basically a matrix circuit. Even if an operation error occurs due to noise, its influence time is much shorter than the driving time of the heating element, i.e., only a noise occurrence time of about 10 nsec, so ink ejection is hardly influenced. That is, compared to a case wherein a recording operation is performed by only selecting the recording elements, a reliable recording operation can be executed while further suppressing the probability of an operation error.

Fourth Embodiment of Recording Head IJH

Figure 8:
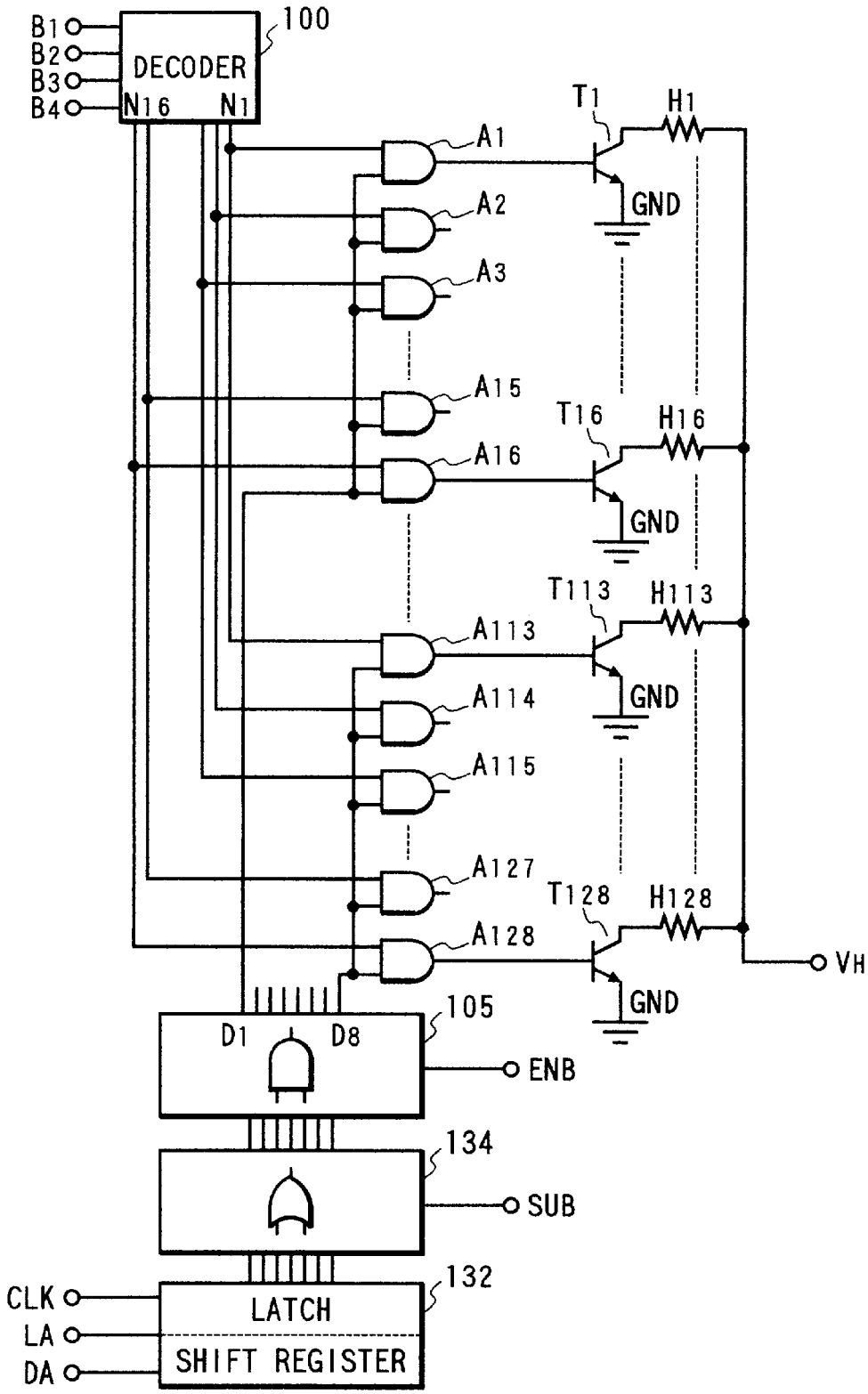
FIG. 8 is a circuit diagram showing the arrangement of a driving circuit according to the fourth embodiment of the present invention.

FIG. 8 is a block diagram showing the electrical configuration of ejection heaters and a driving circuit in this embodiment. In this circuit, a temperature sensor (not shown) is built in a board to allow monitoring the temperature of a print head on the basis of the output. This circuit is constituted by adding an OR gate circuit 134 to the recording head IJH of the second embodiment. Both the shift register 103 and the latch circuit 104 are denoted by a reference numeral 132.

Eight print data DATA corresponding to eight ejection heaters to be simultaneously driven are input to the shift register 132 in synchronism with a clock signal CLK, and latched in response to a latch signal LA. The 8 data latched by the shift register 132 are sent to an AND gate circuit 105 through the OR gate circuit 134.

The OR gate circuit 134 is the main part of this embodiment, and has 8 OR gates each having one input terminal for receiving print data and the other input terminal for receiving a temperature preservation signal SUB. The temperature preservation signal SUB is a signal for applying energy to the ejection heater to such a degree not to bubble or eject the ink. The energy amount is properly determined in accordance with the arrangement, size, and the like of the ejection heater. For example, the temperature preservation signal SUB can:be set as a signal having a high-level period of 0.3 $\mu$sec an d a frequency of 1 MHz. This signal is continuously supplied when the temperature of the print head is lower than a predetermined value, and its supply is stopped when the temperature of the print head exceeds a predetermined temperature.

The AND gate circuit 105 has 8 AND gates each having one input terminal for receiving the output from the OR gate, and the other input terminal for receiving the enable signal ENB. The enable signal ENB is a pulse signal used to define an optimal width for ejecting the ink by driving the ejection heater.

The outputs from the AND gate circuit 105 and th e outputs from a decoder 100 are ANDed by AND gates A1 to A128 corresponding to ejection heaters H1 to H128. By the AND outputs, transistors T1 to T128 as power control elements are driven. Note that the transistor may be of a bipolar type or an MOS type.

When an Si board is used for the ejection heaters, the above circuit can be easily formed on this board by a normal IC manufacturing process.

In this embodiment, when the printer is in a non-print state, "non-driving" data DA is sent as print data, while the enable signal ENB is supplied. If the temperature preservation/heating signal SUB is supplied in accordance with the temperature of the print head, the temperature of the print head can be increased, and the print head can be kept at a proper temperature.

The temperature preservation/heating signal SUB need not be changed depending on whether printing is being performed. This is because, even if this signal is supplied to one input terminal of the OR gate, the OR gate functions to supply predetermined print data to an ejection heater associated with the printing operation during the operation. In addition, no excess driving signal is supplied to the ejection heater driven to perform ejection in accordance with the print data.

Figure 9:
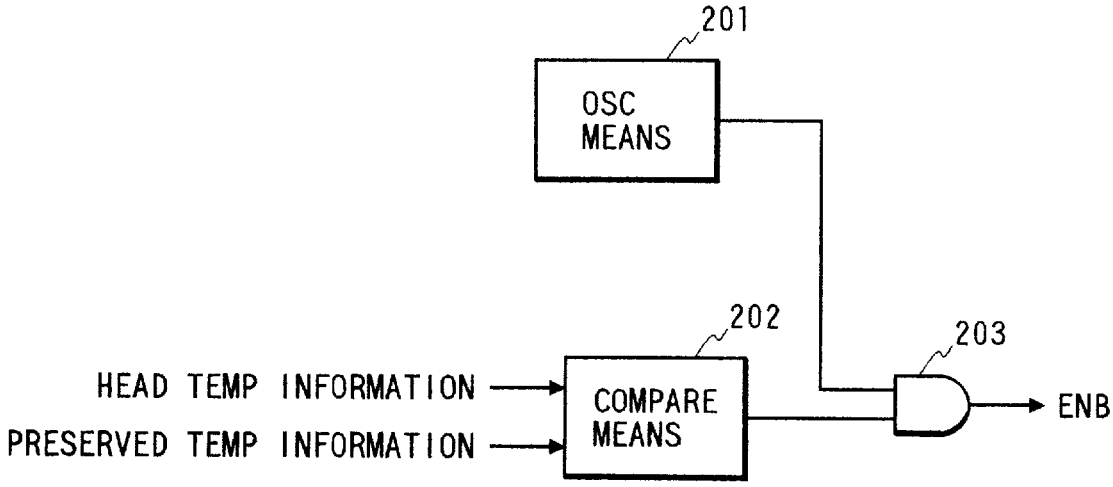
FIG. 9 is a block diagram showing an example of the circuit arrangement for supplying a temperature preservation/heating signal to the circuit in FIG. 8.

The temperature preservation/heating signal SUB can be generated using an arrangement shown in FIG. 9. This arrangement comprises an oscillation (OSC) means 201 for outputting a signal with the above pulse width at the above frequency, a compare means 202 for comparing the temperature information of the print head with preserved temperature information, and supplying a predetermined output when the head temperature is lower, and an AND gate 203 for receiving the outputs from the oscillation means 201 and the compare means 202, and outputting an oscillation output as the temperature preservation/heating signal SUB only when the head temperature is low.

Although this circuit can be arranged integrally with the print head, it can be arranged on the printer main assembly side in order to prevent an increase in print head size. In this case, for example, this circuit can be constituted as hardware using a logical circuit in a controller generally arranged in a printer, or some or all of its functions can be realized by software. As for a means for supplying the temperature information of the print head, a diode, a resistor, or the like incorporated in the print head can be used as a temperature sensor. Alternatively, a means for estimating the head temperature by a logic operation or the like based on the outer temperature and driving conditions in accordance with an image to be printed can be employed.

In a conventional method of controlling the temperature by a heating element independently of the ejection heater, if a print operation starts during increasing the temperature of the print head by driving the heating element, heat generated upon the print operation may be applied to excessively increase the temperature of the print head. Whether such a phenomenon occurs depends on the contents of image data. To suppress occurrence of this phenomenon requires complicated control.

To the contrary, in this embodiment, since no excess heat is generated when print data instructing "ejection" is output, this phenomenon can be prevented.

In this embodiment, the width of the pulse signal supplied as the enable signal ENB is frequently adjusted in accordance with variations in characteristics due to, e.g., variations in size of the ejection heaters in manufacturing. This adjustment is performed to make the heat generation amount almost constant regardless of the variations in characteristics of the ejection heaters. In this embodiment, since the application period of the temperature preservation/heating signal SUB to the ejection heater is also defined by the enable signal, the heat generation amount for temperature preservation can be made almost constant without adjusting the signal SUB itself. This advantage is attained because the means (OR gate circuit 134) for supplying a signal for causing the ejection heater to generate heat regardless of print data is arranged on the upper stream side of the signal flow than the means (AND gate circuit 105) for controlling the width of the pulse signal to be supplied to the ejection heater.

In this embodiment, the transistors serving as power supply control elements, and the shift register serving as a logic circuit for sorting and distributing driving signals in accordance with print data, and the like are integrally arranged on the heater board. The number of wiring lines between the print head and the printer main assembly using it can be decreased. If internal wiring lines to the circuit 134 having a group of OR gates as the main part of this embodiment, and to the respective OR gates are simultaneously formed, only one common wiring line is added between the circuit 134 and the printer main assembly.

In this embodiment, a plurality of heating elements (ejection heaters) are wired in an N×M matrix, and the logic circuit separately drives every M heating elements N times to drive all the heating elements. The number of output signal lines extending from the shift register for sorting and distributing print data is M, so that the number of required OR gates is also M to downsize the OR gate circuit.

In addition, when a diode matrix circuit is employed, the gate circuit must be not a simple logic circuit but a power control circuit. In the arrangement of this embodiment, however, no power control circuit is required.

Note that the number of heating elements, the number of heating elements to be simultaneously driven, the division number, and the like, which are described above, are merely examples, and are arbitrarily determined, as a matter of course.

Fifth Embodiment of Recording Head IJH

In the fourth embodiment, the means for supplying a signal for causing the ejection heater to generate heat regardless of print data is arranged on the upper stream side of the signal flow relative to the means for controlling the width of the pulse signal to be supplied to the ejection heater. This means is also effectively arranged immediately before the power control means in the signal flow.

Figure 10:
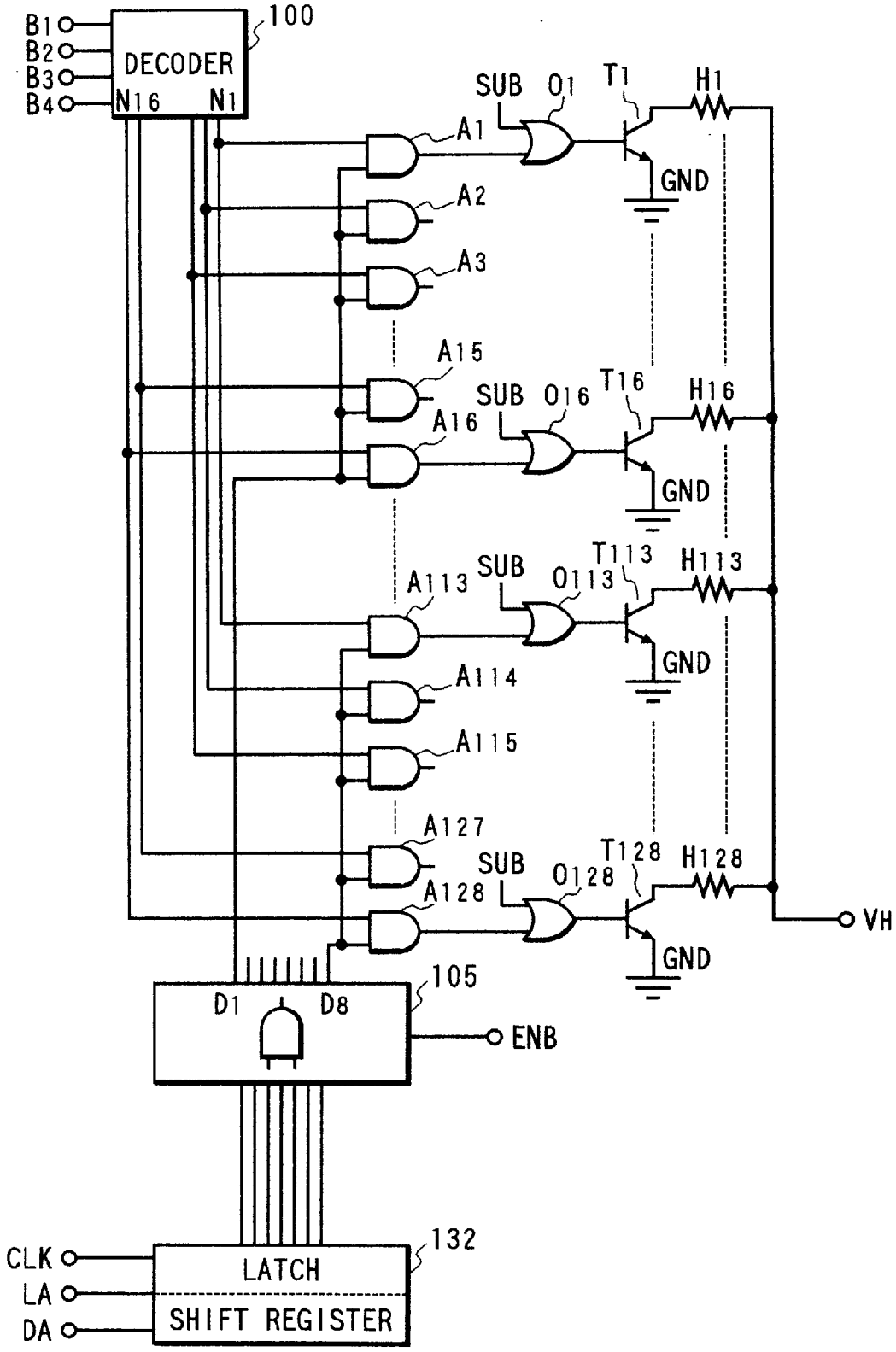
FIG. 10 is a circuit diagram showing the arrangement of a driving circuit according to the fifth embodiment of the present invention.

FIG. 10 shows an example of this arrangement. OR gates O1 to O128 each for receiving the AND output and the temperature preservation/heating signal SUB and supplying an OR output are inserted between transistors T1 to T128 and AND gates A1 to A128, respectively. With this arrangement, when the temperature preservation/heating signal SUB is supplied to the OR gates O1 to O128, ejection heaters H1 to H128 are caused to generate heat regardless of various signals supplied to the print head, thereby heating the print head and keeping its temperature.

More specifically, in the arrangement of FIG. 8 according to the fourth embodiment, when the ambient temperature is very low, the heat generation amount may be short, and to increase the temperature of the print head requires a long time. This is because the temperature preservation/heating signal SUB is supplied to only a group of ejection heaters which are selected by the decoder 100 and simultaneously driven in printing an image.

To the contrary, in this embodiment, since the temperature preservation/heating signal SUB is also supplied to ejection heaters which are not selected by the decoder 100 at that time, all the ejection heaters can be caused to generate heat. Even when the ambient temperature is very low, the temperature of the print head can be quickly increased. If such a case need not be considered, the circuit of the fourth embodiment is also effective, as a matter of course.

In the circuits of FIGS. 8 and 10, the temperature preservation/heating signal SUB having a predetermined energy amount is supplied to one input terminal of each of all the OR gates. A plurality of temperature preservation/heating signals SUB having different energy amounts can be selectively supplied.

For example, in the use of a so-called elongated print head in which the alignment range of ejection outlets or ejection heaters is wide, the temperature may vary in this alignment. To cope with such a case, a plurality of temperature detection elements may be arranged on the print head, and one of a plurality of temperature preservation/heating signals may be selected and supplied in correspondence with each detected temperature.

In the arrangement of FIG. 8, one OR gate for supplying the temperature preservation/heating signal corresponds to 16 ejection heaters, which are close to each other. If the temperature preservation/heating signal SUB having a proper energy amount is supplied in accordance with the detected temperature, the temperature of the print head can be partially controlled.

The present invention is particularly suitable for use in an ink jet recording head and recording apparatus wherein thermal energy generated by an electrothermal transducer, a laser beam or the like is used to cause a change of state of the ink to eject or discharge the ink. This is because the high density of the picture elements and the high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include a capping means for the recording head, cleaning means therefore, pressurizing or suction means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one of the techniques described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording head comprising:

M×N recording elements which are divided into N blocks each having M recording elements;

M×N driving circuits for energizing and driving said M×N recording elements;

a selection circuit for generating block selection signals for selecting blocks for divisional driving, in accordance with block control signals entered externally;

an input circuit for inputting recording data, adding an enable signal for enabling the driving of the recording elements, and outputting a recording data signal corresponding to M recording elements; and an output circuit for outputting a driving signal for driving said driving circuits in accordance with the recording data signal entered from said input circuit and the block selection signals generated by said selection circuit, wherein said selection circuit outputs N block selection signals based on L (L<N) block control signals.

2. A head according to claim 1, wherein said output circuit calculates ANDs between the recording data signal of M-bit parallel and the block selection signals, and outputs the driving signal for driving said recording elements based on a calculation result.

3. A head according to claim 1, wherein said input circuit comprises a shift register for serially inputting and temporarily storing the recording data in response to a supplied clock, and a latch circuit for latching the recording data stored in said shift register, and wherein the enable signal enables the driving of the recording data outputted from said latch circuits.

4. A head according to claim 1, wherein said output circuit comprises an AND circuit for calculating ANDs between the block selection signals and the recording data signal, and outputs the driving signal to said driving circuits in accordance with a calculation result of said AND circuit.

5. A head: according to claim 1, wherein said input circuit comprises a plurality of flip-flops for inputting and temporarily holding the recording data, a latch circuit for latching the recording data stored in said flip-flops, and a decoding circuit for inputting and decoding a selection signal, and selecting a flip-flop which should hold the recording data, from said plurality of flip-flops in accordance with a decoding result.

6. A head according to claim 1, wherein said recording elements comprise heaters.

7. A head according to claim 6, wherein said recording head ejects an ink by using thermal energy generated from said heaters.

8. A head according to claim 7, further comprising:

heating signal supplying means, arranged on a supply path of the driving signal for performing ejection in accordance with the recording data to said heaters, for receiving the driving signal and a heating signal for generating thermal energy to such a degree not to cause ejection, and for supplying the driving signal to a heater to be driven in accordance with the recording data, and the heating signal to a heater not to be driven in accordance with the recording data.

9. A head according to claim 8, wherein said heating signal supplying means includes a gate circuit element.

10. A head according to claim 9, wherein said gate circuit element is an OR gate circuit element.

11. A head according to claim 9, wherein said gate circuit element is arranged midway along the supply path of the driving signal to M heaters.

12. A head according to claim 11, wherein said gate circuit element is arranged on the supply path immediately before said driving circuits corresponding to said plurality of heaters.

13. A head according to claim 1, wherein said output circuit comprises a circuit for modifying the recording data by calculating a logical AND between the recording data and a signal to permit the outputting of the driving signal.

14. A head according to claim 1, wherein said head is detachably mounted in an apparatus.

15. A recording apparatus comprising:

a recording head, said recording head comprising:

M×N recording elements which are divided into N blocks each having M recording elements, M×N driving circuits for energizing and driving said M×N recording elements, a selection circuit for generating block selection signals for selecting blocks for divisional driving, in accordance with block control signals entered externally, an input circuit for inputting recording data, adding an enable signal for enabling the driving of the recording elements, and outputting a recording data signal corresponding to M recording elements, and an output circuit for outputting a driving signal for driving said driving circuits in accordance with the recording data signal entered from said input circuit and the block selection signals generated by said selection circuit;

means for supplying the recording data to said recording head; and means for supplying L (L<N) block control signals to said recording head, wherein said selection circuit outputs the block selection signals based on the L block control signals.

16. An apparatus according to claim 15, wherein said output circuit comprises a circuit for modifying the recording data by calculating a logical AND between the recording data and a signal to permit the outputting of the driving signal.

17. A substrate comprising:

M×N recording elements which are divided into N blocks each having M recording elements;

M×N driving circuits for energizing and driving said M×N recording elements;

a selection circuit for generating block selection signals for selecting blocks for divisional driving, in accordance with block control signals entered externally;

an input circuit for inputting recording data, adding an enable signal for enabling the driving of the recording elements, and outputting a recording data signal corresponding to M recording elements; and an output circuit for outputting a driving signal for driving said driving circuits in accordance with the recording data signal entered from said input circuit and the block selection signals generated by said selection circuit, wherein said selection circuit outputs N block selection signals based on L (L<N) block control signals.

18. A substrate according to claim 17, wherein said output circuit calculates ANDs between the recording data signal of M-bit parallel and the block selection signals, and outputs the driving signal for driving said recording elements based on a calculation result.

19. A substrate according to claim 17, wherein said input circuit comprises a shift register for serially inputting and temporarily storing the recording data in response to a supplied clock, and a latch circuit for latching the recording data stored in said shift register, and wherein the enable signal enables the driving of the recording data outputted from said latch circuit.

20. A substrate according to claim 17, wherein said output circuit comprises an AND circuit for calculating ANDs between the block selection signals and the recording data signal, and outputs the driving signal to said driving circuits in accordance with a calculation result of said AND circuit.

21. A substrate according to claim 17, wherein said input circuit comprises:

a plurality of flip-flops for inputting and temporarily holding the recording data, a latch circuit for latching the recording data stored in said flip-flops, and a decoding circuit for inputting and decoding a selection signal, and selecting a flip-flop which should hold the recording data, from said plurality of flip-flops in accordance with a decoding result.

22. A substrate according to claim 17, wherein said recording elements comprise heaters.

23. A substrate according to claim 17, wherein said output circuit comprises a circuit for modifying the recording data by calculating a logical AND between the recording data and a signal to permit the outputting of the driving signal.

24. A recording head comprising:

M×N recording elements which are divided into N blocks each having M recording elements;

M×N driving circuits for energizing and driving said M×N recording elements;

a block selection signal output circuit for outputting block selection signals in accordance with a block control signal entered externally and an enable signal for enabling the driving of said recording elements;

an input circuit for inputting recording data and outputting recording data corresponding to M recording elements; and an output circuit for outputting a signal for driving said driving circuits in accordance with the recording data entered from said input circuit and the block selection signals outputted from said block selection signal output circuit.

25. A head according to claim 24, wherein said output circuit calculates ANDs between the recording data of M-bit parallel and the block selection signals, and outputs the driving signal based on a calculation result.

26. A head according to claim 24, wherein said head is detachably mounted in an apparatus.

27. A substrate comprising:

M×N recording elements which are divided into N blocks each having M recording elements;

M×N driving circuits for energizing and driving said M×N recording elements;

a block selection signal output circuit for outputting block selection signals in accordance with a block control signal entered externally and an enable signal for enabling the driving of said recording elements;

an input circuit for inputting recording data and outputting recording data corresponding to M recording elements; and an output circuit for controlling a signal for driving said driving circuits in accordance with the recording data entered from said input circuit and the block selection signals outputted from said block selection signal output circuit.

28. A substrate according to claim 27, wherein said output circuit calculates ANDs between the recording data of M-bit parallel and the block selection signals, and outputs the driving signal based on a calculation result.

29. A substrate according to claim 27, wherein said input circuit comprises a shift register for serially inputting and temporarily storing the recording data in response to a supplied clock, and a latch circuit for latching the recording data stored in said shift register, and wherein the enable signal enables the driving of the recording data outputted from said latch circuit.

30. A substrate according to claim 27, wherein said output circuit comprises and AND circuit for calculating ANDs between the block selection signals and the recording data, and outputs the driving signal to said driving circuit in accordance with a calculation result of said AND circuit.

31. A recording apparatus comprising:

a recording head, said recording head comprising:

M×N recording elements which are divided into N blocks each having m recording elements, M×N driving circuits for energizing and driving said M×N recording elements, a block selection signal output circuit for outputting block selection signals in accordance with a block control signal entered externally and an enable signal for enabling the driving of said recording elements, an input circuit for inputting recording data and outputting recording data corresponding to M recording elements, and an output circuit for outputting a signal for driving circuits in accordance with the recording data entered form said input circuit and the block selection signals output from said block selection signal output circuit; and means for supplying the recording data to said recording head.

* * * * *

UNITED STATES PATENT AND TRADEMARK OFFICE

CERTIFICATE OF CORRECTION

PATENT NO. : 6,520,613 B1 
DATED : February 18, 2003
INVENTOR(S) : Tamura

It is certified that error appears in the above-identified patent and that said Letters Patent is hereby corrected as shown below:

Title page,
Item [56], References Cited, FOREIGN PATENT DOCUMENTS, "54056847 5/1979" should read -- 54-056847 5/1979 --; "59123670 7/1984" should read -- 59-123670 7/1984 --; "60071260 4/1985" should read -- 60-071260 4/1985 --; "3153367 7/1991" should read -- 3-153367 7/1991 --; and "59138461 8/1994" should read -- 59-138461 8/1984 --.
Item [57], ABSTRACT,
Line 1, "Disclose" should read -- Disclosed --.

Column 1,
Line 27, "at to be" should read -- at once to be --.
Line 32, "head;and" should read -- head and --.

Column 2,
Line 42, "head," should read -- head --.

Column 3,
Line 11, ":circuit" should read -- circuit --.
Line 52, "Preferred;embodiments" should read -- Preferred embodiments --.

Column 4,
Line 50, "with:" should read -- with --.

Column 6,
Line 31, "the;recording" should read -- the recording --.

Column 7,
Line 44, "size,than" should read -- size than --.

Column 8,
Line 33, "can:be" should read -- can be --.
Line 34, "an d" should read -- and --.
Line 45, "th e" should read -- the --.

Column 13,
Line 20, "circuits." should read -- circuit. --.
Line 27, "head:" should read -- head --.
Line 60, "claim 11," should read -- claim 9, --.

UNITED STATES PATENT AND TRADEMARK OFFICE

CERTIFICATE OF CORRECTION

PATENT NO. : 6,520,613 B1 
DATED : February 18, 2003
INVENTOR(S) : Tamura

It is certified that error appears in the above-identified patent and that said Letters Patent is hereby corrected as shown below:

Column 16,
Line 24, “and” should read -- an --.
Line 32, “m” should read -- M --.
Line 44, “form” should read -- from --.

Signed and Sealed this

Twentieth Day of January, 2004

JON W. DUDAS
*Acting Director of the United States Patent and Trademark Office*